US008511994B2

(12) United States Patent
Devore et al.

(10) Patent No.: US 8,511,994 B2
(45) Date of Patent: Aug. 20, 2013

(54) SERPENTINE CORED AIRFOIL WITH BODY MICROCIRCUITS

(75) Inventors: Matthew A. Devore, Manchester, CT (US); Matthew S. Gleiner, Vernon, CT (US); Douglas C. Jenne, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 677 days.

(21) Appl. No.: 12/623,703

(22) Filed: Nov. 23, 2009

(65) Prior Publication Data

US 2011/0123311 A1 May 26, 2011

(51) Int. Cl.
*F01D 5/18* (2006.01)

(52) U.S. Cl.
USPC ..... 416/97 R

(58) Field of Classification Search
USPC ..... 415/115; 416/90 R, 96 R, 97 A, 416/97 R
See application file for complete search history.

(56) References Cited

U.S. PATENT DOCUMENTS

| | | | | |
|---|---|---|---|---|
| 4,770,608 | A * | 9/1988 | Anderson et al. | 416/97 R |
| 5,342,172 | A | 8/1994 | Coudray et al. | |
| 5,392,515 | A | 2/1995 | Auxier et al. | |
| 5,405,242 | A | 4/1995 | Auxier et al. | |
| 5,419,039 | A | 5/1995 | Auxier et al. | |
| 5,813,836 | A * | 9/1998 | Starkweather | 416/97 R |
| 5,931,638 | A | 8/1999 | Krause et al. | |
| 5,993,156 | A | 11/1999 | Bailly et al. | |
| 6,254,334 | B1 | 7/2001 | LaFleur | |
| 6,379,118 | B2 * | 4/2002 | Lutum et al. | 416/97 R |
| 6,402,470 | B1 | 6/2002 | Kvasnak et al. | |
| 6,514,042 | B2 | 2/2003 | Kvasnak et al. | |
| 6,769,866 | B1 | 8/2004 | Kannefass et al. | |
| 6,890,154 | B2 | 5/2005 | Cunha | |
| 6,896,487 | B2 | 5/2005 | Cunha et al. | |
| 6,932,571 | B2 | 8/2005 | Cunha et al. | |
| 6,955,525 | B2 * | 10/2005 | Liang | 416/97 R |
| 7,097,425 | B2 | 8/2006 | Cunha et al. | |
| 7,131,818 | B2 | 11/2006 | Cunha et al. | |
| 7,217,095 | B2 | 5/2007 | Pietraszkiewicz et al. | |
| 7,311,498 | B2 | 12/2007 | Cunha et al. | |
| 7,364,405 | B2 | 4/2008 | Cunha et al. | |
| 7,371,049 | B2 | 5/2008 | Cunha et al. | |
| 7,513,744 | B2 | 4/2009 | Cunha et al. | |
| 7,581,927 | B2 | 9/2009 | Cunha et al. | |
| 7,717,675 | B1 * | 5/2010 | Liang | 416/95 |
| 7,806,659 | B1 * | 10/2010 | Liang | 416/97 R |
| 7,845,906 | B2 * | 12/2010 | Spangler et al. | 416/97 R |
| 2005/0053459 | A1 * | 3/2005 | Cunha et al. | 415/115 |
| 2007/0116568 | A1 * | 5/2007 | Cunha et al. | 416/97 R |
| 2008/0175714 | A1 * | 7/2008 | Spangler et al. | 416/232 |

* cited by examiner

*Primary Examiner* — Edward Look
*Assistant Examiner* — Laim McDowell
(74) *Attorney, Agent, or Firm* — Carlson, Gaskey & Olds, PC

(57) ABSTRACT

A gas turbine engine component has an airfoil that extends from a leading edge to a trailing edge, and a suction side and has a pressure side. There are cooling passages extending from a root of the airfoil toward a tip of the airfoil. The cooling passages include a straight passage extending from the root toward the tip and adjacent the leading edge. A serpentine passage has at least three connected paths and is spaced from the straight passage toward the trailing edge. A cooling circuit is provided between the pressure wall and each of the three serpentine paths, and the straight path. A cooling circuit is provided between the suction wall and the straight passage. There is no cooling between at least a downstream one of the at least three paths of the serpentine passage and the suction wall.

3 Claims, 2 Drawing Sheets

SERPENTINE CORED AIRFOIL WITH BODY MICROCIRCUITS

This invention was made with government support under Contract No. F33615-03-D-2354-0009 awarded by the United States Air Force. The Government may therefore have certain rights in this invention.

BACKGROUND OF THE INVENTION

Gas turbine engines are known and include a compressor which compresses a gas and delivers it into a combustion chamber. The compressed air is mixed with fuel and combusted, and products of this combustion pass downstream over turbine rotors.

The turbine rotors typically carry blades having an airfoil. In addition, static vanes are positioned adjacent to the blades to direct the flow of the products of combustion at the blades. Both the blades and the vanes are exposed to very high temperatures, and thus cooling schemes are known for providing cooling air to the airfoils of the blades and vanes.

Cooling circuits are formed within the airfoil body to circulate cooling air. One type of cooling circuit is a serpentine channel. In a serpentine channel, air flows serially through a plurality of paths, and in opposed directions. Thus, air may initially flow in a first path from a platform of a turbine blade outwardly through the airfoil and reach a position adjacent an end of the airfoil. The flow is then returned in a second path, back in an opposed direction toward the platform. Typically, the flow is again reversed back away from the platform in a third path.

The assignee of the present invention has developed a serpentine channel combined with cooling circuits that are embedded into the wall of an airfoil, which have been called microcircuits. Example microcircuits are disclosed in U.S. Pat. No. 6,896,487, entitled "Microcircuit Airfoil Main Body," and which issued on May 24, 2005.

It is known to provide a turbine blade having microcircuit cooling adjacent the entire length of both a suction side and a pressure side.

SUMMARY OF THE INVENTION

A gas turbine engine component has an airfoil that extends from a leading edge to a trailing edge, and has a suction side and a pressure side. There are cooling passages extending from a root of the airfoil toward a tip of the airfoil. The cooling passages include a straight passage extending from the root toward the tip and adjacent the leading edge. A serpentine passage has at least three connected paths and is spaced from the straight passage toward the trailing edge. Side cooling circuits are provided between the pressure wall and each of the three serpentine paths, and the straight path. A side cooling circuit is provided between the suction wall and the straight passage. There is no side cooling circuit between at least a downstream leg of one of the paths of the serpentine passage and the suction wall.

These and other features of the present invention can be best understood from the following specification and drawings, the following of which is a brief description.

DETAILED DESCRIPTION OF THE PREFERRED EMBODIMENT

Figure 1:
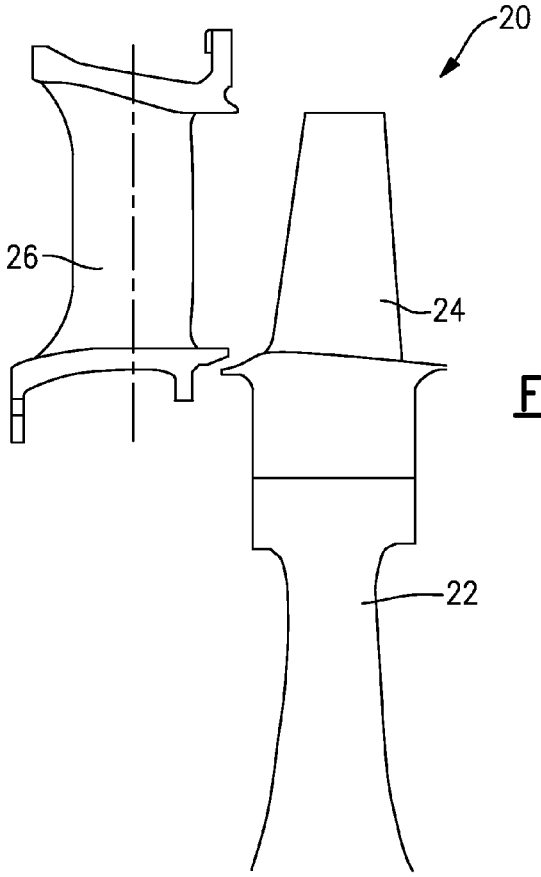
FIG. 1 shows a portion of a gas turbine engine.

As shown in FIG. 1, a gas turbine engine 20 includes a turbine rotor 22 carrying blades 24. The blades are positioned adjacent a vane 26. Both the vane 26 and blade 24 have airfoils, and the airfoils may be provided with cooling schemes. While the present invention will be specifically disclosed in a blade, it may also have application in a vane.

Figure 2:
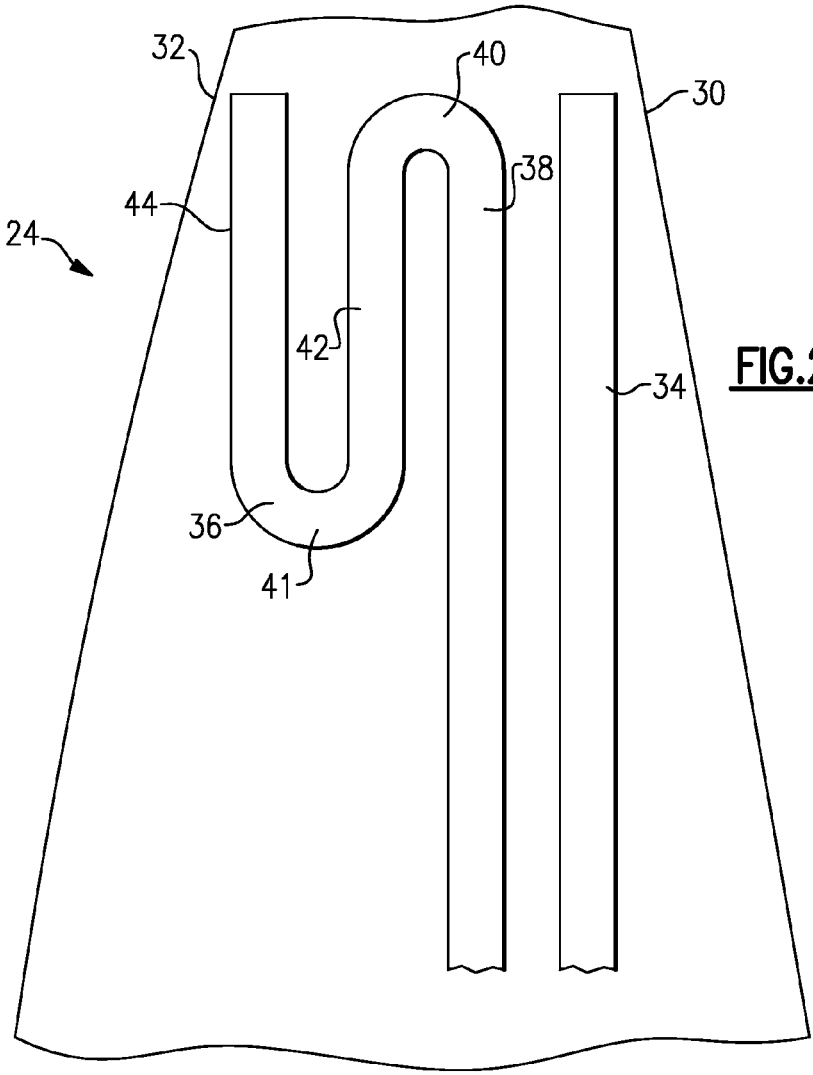
FIG. 2 shows a portion of a turbine blade airfoil.

As shown in FIG. 2, the blade 24 extends from a leading edge 30 to a trailing edge 32. Internal cooling passages 34 and 36 are defined in the blade 24. The passage 36 is a serpentine passage having passes out, back and out within the airfoil. As shown, the serpentine passage 36 has a first portion 38 extending from a root of the airfoil outwardly toward a tip of the airfoil. The serpentine path then turns back at 40 into path 42 which extends back toward the root of the blade to a bend 41, which in turn extends back to a path 44 to the tip. While the serpentine path is shown flowing from the leading edge rearwardly toward the trailing edge, it could also flow in the opposed direction, and still come within the scope of this application.

Figure 3:
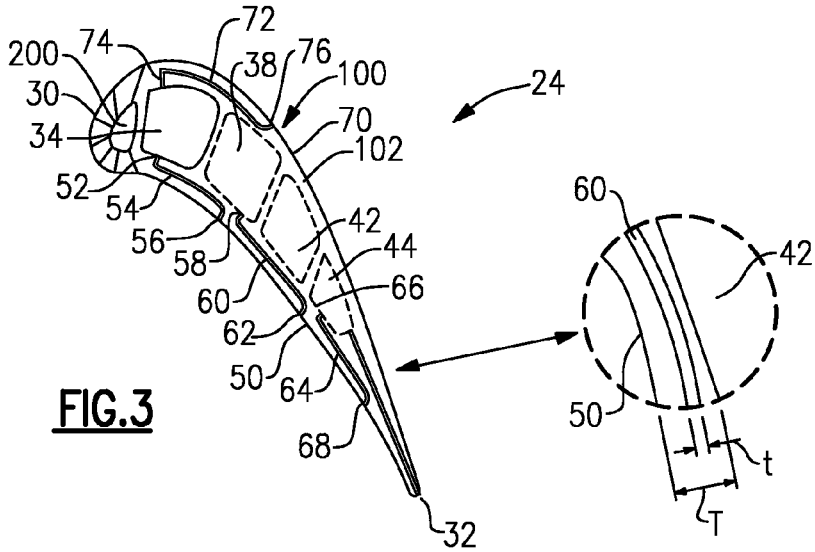
FIG. 3 is a cross-sectional view through the FIG. 2 airfoil.

FIG. 3 is a cross-sectional view through the blade 24 and shows the cooling passages 34, 38, 42 and 44. As can be appreciated in this Figure, there is another cooling passage 200.

Microcircuit cooling is provided by microcircuits 54, 60 and 64 on the pressure side 50 of the airfoil. Microcircuit 54 has an inlet 52 from the passage 34 and outlets the cooling air at 56 onto the skin of the pressure side 50. Microcircuit 60 has an inlet 58 from the passage 38, and outlets the cooling air at 62 onto the pressure side 50. Microcircuit 64 has an inlet 66 from the passage 44 and outlets its air at 68 on the pressure side 50. Microcircuit 72 has an inlet 74 from the passage 34, and outlets its air at 76 on the suction side 102. Notably, this outlet 76 is approximately at a gage point 100. Between the gage point 100 and the trailing edge 32, there are no microcircuits. Thus, there are microcircuits between the passages 34, 38, 42, and 44, and the pressure side 50, but no microcircuits between the passages 42 and 44 and the suction side 102. In this manner, the trailing edge suction side is cooled by the serpentine cooling path. The microcircuit is shown in exaggerated width to better illustrate its basic structure. The exact dimensional ranges, etc., are disclosed below.

As can be appreciated from FIG. 3, there are three microcircuits on the pressure wall 50. Microcircuit 54 taps air from the straight passage 34. Microcircuit 60 taps air from an upstream one 38 of the three serpentine paths 36, and extends along the pressure wall, and between an intermediate one 42 of the three serpentine paths and the pressure wall. A third microcircuit 64 taps air from a downstream one 44 of the three serpentine paths, and delivers air onto the pressure wall. The microcircuit 72 on the suction wall 70 extends along the suction wall, and is between a portion of an upstream one 38 of the three serpentine paths and the suction wall before delivering air to the outlet.

Figure 4:
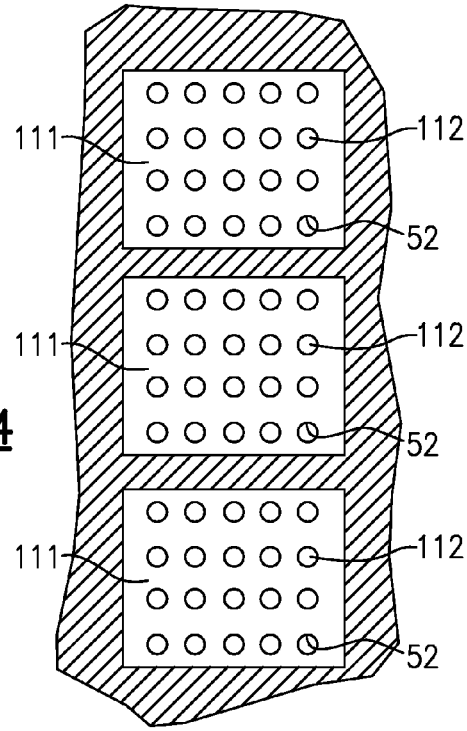
FIG. 4 shows an example microcircuit cooling scheme.

As can be appreciated from FIG. 4, there are preferably a plurality of microcircuits 111 spaced along the length of the airfoil, and into and out of the plane of FIG. 3. Each microcircuit shown in FIG. 3 may be a single or a plurality of spaced circuits. The features of this application are shown utilized with microcircuit cooling, however, other types of cooling circuits could be placed between the central passages and the pressure and suction wall and are generically referred to as side cooling circuits.

The detail of the microcircuit can have many distinct shapes, positions, spacings, etc., and varying numbers of entry/exhaust passages per microcircuit, and relative shapes and sizes of the pedestals 112 that are included. For purposes of this application, a microcircuit is preferably simply a very thin circuit placed at an area where additional cooling is beneficial. The microcircuits that come within the scope of this invention can have varying combinations of pedestal shapes and sizes.

In the exemplary embodiment, a thickness, t (see FIG. 3), of the microcircuit 111, as measured into the wall, is preferably of approximately about 0.010 inch (0.254 mm) to approximately about 0.030 inch (0.762 mm), and most preferably about less than 0.017 inch (0.432 mm). These dimensions are for a turbine blade having a wall thickness T about 0.045-0.125 inch (1.143 mm-3.175 mm).

The microcircuits 54, 60, and 64 may be formed from any suitable core material known in the art. For example, the microcircuits 54, 60, and 64 may be formed from a refractory metal or metal alloy such as molybdenum or a molybdenum alloy. Alternatively, each of the microcircuits 54, 60, and 64 may be formed from a ceramic or silica material.

Various cooling structures may be included in the passages 34 and 36 as well as the microcircuits 54, 60, and 64. Pin fins, trip strips, guide vanes, pedestals, etc., may be placed within the passages and microcircuits to manage stress, gas flow, and heat transfer.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A gas turbine engine component comprising:

an airfoil, said airfoil extending from a leading edge to a trailing edge, and having a suction side having a suction wall and a pressure side having a pressure wall;

cooling passages extending from a root of said airfoil toward a tip of said airfoil, and said cooling passages including a straight passage extending from said root toward said tip and adjacent said leading edge, and a serpentine passage having at least three connected paths and spaced from said straight passage toward said trailing edge;

a respective pressure side cooling circuit provided between said pressure wall and each corresponding one of said at least three connected serpentine paths, and said straight passage, and a suction side cooling circuit provided between said suction wall and said straight passage, but there being no side cooling circuit between at least a downstream one of said at least three connected paths of said serpentine passage and said suction wall;

each said pressure side cooling circuits and said suction side cooling circuit are all microcircuits and a thickness of said microcircuits measured between said suction or pressure wall and said cooling passages is between .030 and .010 inch: and there being no microcircuit cooling on said suction wall between a gage point and said trailing edge.

2. A gas turbine engine turbine blade comprising:

an airfoil, said airfoil extending from a leading edge to a trailing edge, and having a suction side having a suction wall and a pressure side having a pressure wall;

cooling passages extending from a root of said airfoil toward a tip of said airfoil, and said cooling passages including a straight passage extending from said root toward said tip and adjacent said leading edge, and a serpentine passage having at least three connected paths and spaced from said straight passage toward said trailing edge;

a respective pressure microcircuit provided between said pressure wall and each corresponding of said at least three connected serpentine paths, and said straight passage, and a suction microcircuit provided between said suction wall and said straight passage, but there being no microcircuit cooling between at least a downstream one of said at least three paths of said serpentine passage and said suction wall, and no microcircuit cooling on said suction wall between a gage point and said trailing edge;

said suction microcircuit on said suction wall receiving cooling air from said straight passage, and delivering air to an outlet adjacent the gage point on said suction wall and extending along said suction wall, and being between a portion of an upstream one of said at least three connected serpentine paths and said suction wall before delivering air to the outlet;

three of said pressure microcircuits on said pressure wall, including a first said pressure microcircuit which taps air from said straight passage, a second said pressure microcircuit which taps air from an upstream one of said at least three connected serpentine paths, and extends along said pressure wall, and between an intermediate one of said at least three connected serpentine paths and said pressure wall, and a third said pressure microcircuit which taps air from a downstream one of said at least three connected serpentine paths, and delivers air onto the pressure wall; and a thickness of said pressure microcircuits and said suction microcircuits measured between said suction or pressure wall and said cooling passages is between .030 and .010 inch.

3. The gas turbine engine as set forth in claim 2, wherein there is no suction side cooling circuit between at least the two most downstream ones of said at least three connected serpentine paths and said suction wall.

* * * * *